US012319474B2

(12) United States Patent
Buck

(10) Patent No.: US 12,319,474 B2
(45) Date of Patent: Jun. 3, 2025

(54) PLASTIC CONTAINER AND METHOD OF MANUFACTURE

(71) Applicant: Jeremiah Buck, Wheat Ridge, CO (US)

(72) Inventor: Jeremiah Buck, Wheat Ridge, CO (US)

( * ) Notice: Subject to any disclaimer, the term of this patent is extended or adjusted under 35 U.S.C. 154(b) by 36 days.

(21) Appl. No.: 18/339,507

(22) Filed: Jun. 22, 2023

(65) Prior Publication Data

US 2024/0425243 A1 Dec. 26, 2024

(51) Int. Cl.
*B65D 43/02* (2006.01)
*B65D 43/16* (2006.01)

(52) U.S. Cl.
CPC ..... *B65D 43/021* (2013.01); *B65D 43/162* (2013.01); *B65D 2251/0021* (2013.01); *B65D 2251/0081* (2013.01); *B65D 2543/00092* (2013.01); *B65D 2543/00296* (2013.01); *B65D 2543/00509* (2013.01); *B65D 2543/00648* (2013.01); *B65D 2543/00685* (2013.01); *B65D 2543/0074* (2013.01); *B65D 2543/00796* (2013.01); *B65D 2543/0099* (2013.01)

(58) Field of Classification Search
CPC ..... B65D 43/162; B65D 43/021; B65D 2543/0099; B65D 1/06
See application file for complete search history.

(56) References Cited

U.S. PATENT DOCUMENTS

| | | | | |
|---|---|---|---|---|
| 3,706,393 | A | 12/1972 | Curtis et al. | |
| 5,161,711 | A * | 11/1992 | Picozza | B65D 43/021 220/256.1 |
| 6,325,213 | B1 | 12/2001 | Landis, II | |
| 8,967,414 | B2 | 3/2015 | Lane | |
| 10,457,437 | B2 | 10/2019 | Darr et al. | |
| 2002/0020703 | A1 | 2/2002 | Takiguchi | |
| 2010/0140283 | A1* | 6/2010 | Brozell | B65D 1/06 220/810 |
| 2016/0167844 | A1* | 6/2016 | Wu | B65D 43/162 215/209 |
| 2020/0140135 | A1 | 5/2020 | Deylamian et al. | |

* cited by examiner

*Primary Examiner* — Jeffrey R Allen
(74) *Attorney, Agent, or Firm* — Harpman & Harpman

(57) ABSTRACT

A plastic container having a body member and a bottom insert member which are separately molded. The body member is formed with an open top having attached hinge lid and open bottom having a contoured flange engagement surface in its bottom interior wall. The bottom insert member has a pair of annular registration flange elements registerable within the body bottom flange engagement surfaces with a plurality of annular sealing flanges there between with interlocking the bottom insert in sealing relation therewith.

10 Claims, 6 Drawing Sheets

PLASTIC CONTAINER AND METHOD OF MANUFACTURE

BACKGROUND OF THE INVENTION

1. Technical Field

This invention relates to manufacture of plastic containers and more specifically to plastic containers where the container is made with an open top and bottom.

2. Description of Prior Art

Prior art devices of this type have been developed to provide improved manufacturing process wherein the formation, preferably by plastic injection molding of a container body member and a separate bottom that must be attached and sealed together. Such variations on manufacturing process include integral formed containers and bottoms that can be seen in U.S. Pat. Nos. 3,706,393, 6,325,213, 8,967,414, 10,457,437 and U.S. Publications 2020/0140135 and 2002/0020703.

U.S. Pat. No. 3,706,393 is directed to a plastic container formed with an open bottom and an attached bottom member having upstanding inner and outer edge flanges defining contoured receiving grooves there between securing and sealing same.

U.S. Pat. No. 6,325,123 claims a plastic container having a main opening body with an attached bottom defined by radial bottom rim and an interengaging fusto-conical sidewall and bottom extending respectfully therefrom.

U.S. Pat. No. 8,967,414 discloses a beverage container with a threaded engagement bottom forming a seal.

U.S. Publication 2020/0140135 is directed to a portable container and method of use wherein a bottle body has first and second end forming apertures. A first cap and secured bottle cap are removably coupled to the respective ends of the body.

Finally, in U.S. Publication 2002/0020703 shows a plastic container and method of producing same wherein upper and lower tank members are engaged by abutting portions connected by a plastic band welded there around.

SUMMARY OF THE INVENTION

A plastic container and method of manufacture having an open top and bottom, cylindrical body member with a hinge closer lid and an independent bottom insert member having a retainment and sealing annular flange fittings for internal registration with the body member. Contoured retainment flange disposed walls and annular offset bottom insert flush fitting provide engageable surfaces. Annular sealing flanges define a bottom seal there between.

DETAILED DESCRIPTION OF THE INVENTION

Figure 1:
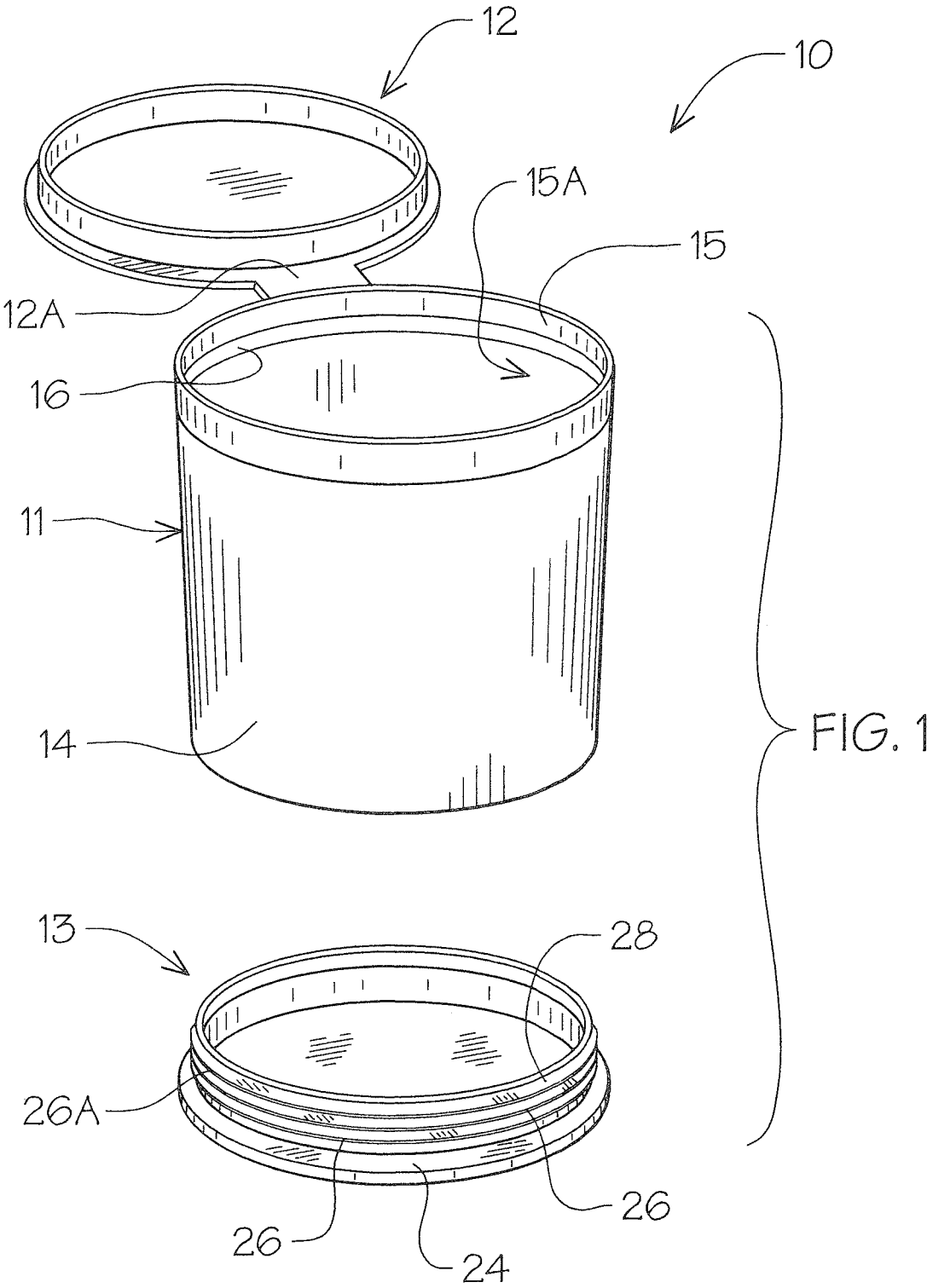
FIG. 1 is an exploded perspective view of the container of the invention.
Figure 2:
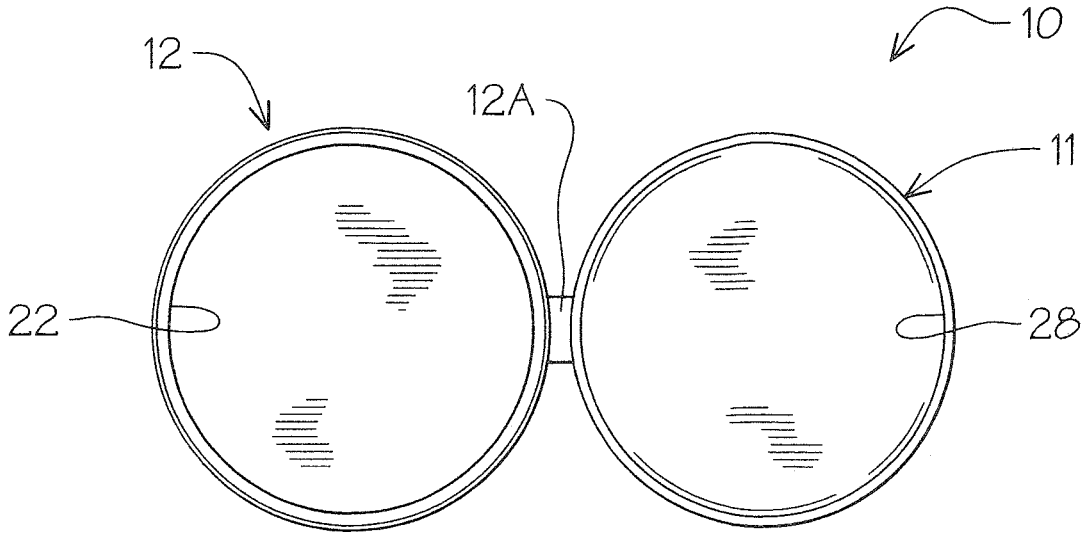
FIG. 2 is a top plan view thereof.

Referring to FIGS. 1 and 2 of the drawings, a container 10 of the invention can be seen having a main cylindrical body 11 with a hinge lid 12 connected by a live hinge 12A. A container bottom insert 13 is positioned for selective registration within the cylinder body 11 as seen in FIG. 1 of the drawings defining a containment vessel adapted for manufacture or in line product filling as will be understood by those skilled in the art.

The main cylinder body 11 has a continuous annular sidewall 14 with an open top defining a lid receiving portion 15 with the annular rib 16 on its inner surface 15A. The lid receiving portion 15 is of an increased diameter defining an offset transition at 17 in the annular sidewall 14, best seen in FIGS. 5 and 6 of the drawings.

Figure 3:
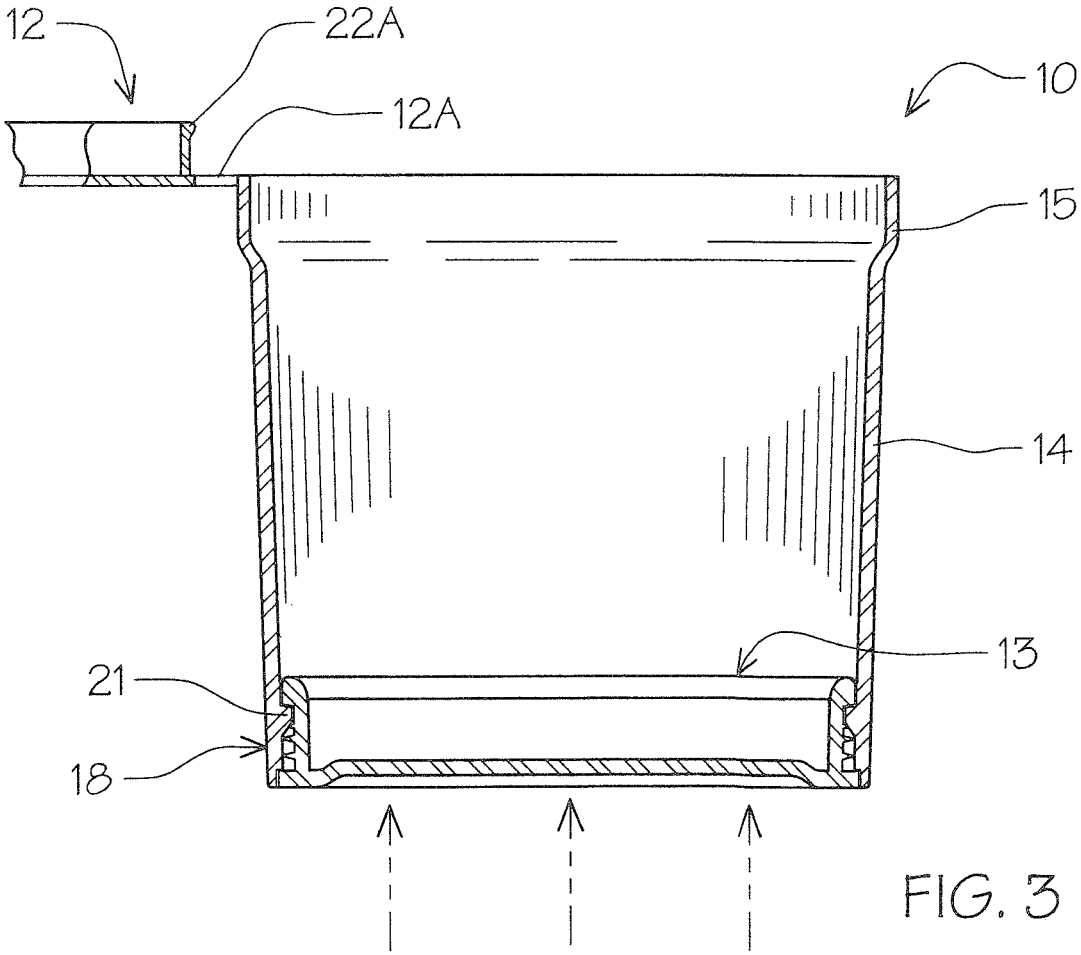
FIG. 3 is an enlarged sectional view with portions broken away of an assembled container in open position.

The cylinder body annular sidewall 14 is, in this example, tapered from the lid receiving portion 15 having an increased wall thickness as it descends terminating with an open bottom interior insert receiving fitting 18, best seen in FIG. 3 of the drawings.

The bottom interior insert receiving fitting 18 has an annular offset base portion 19 with a sealing interior surface 20 extending therefrom to a tapered retainment flange 21 that locks the container bottom 13 in place during assembly as will be described in greater detail hereinafter.

Figure 5:
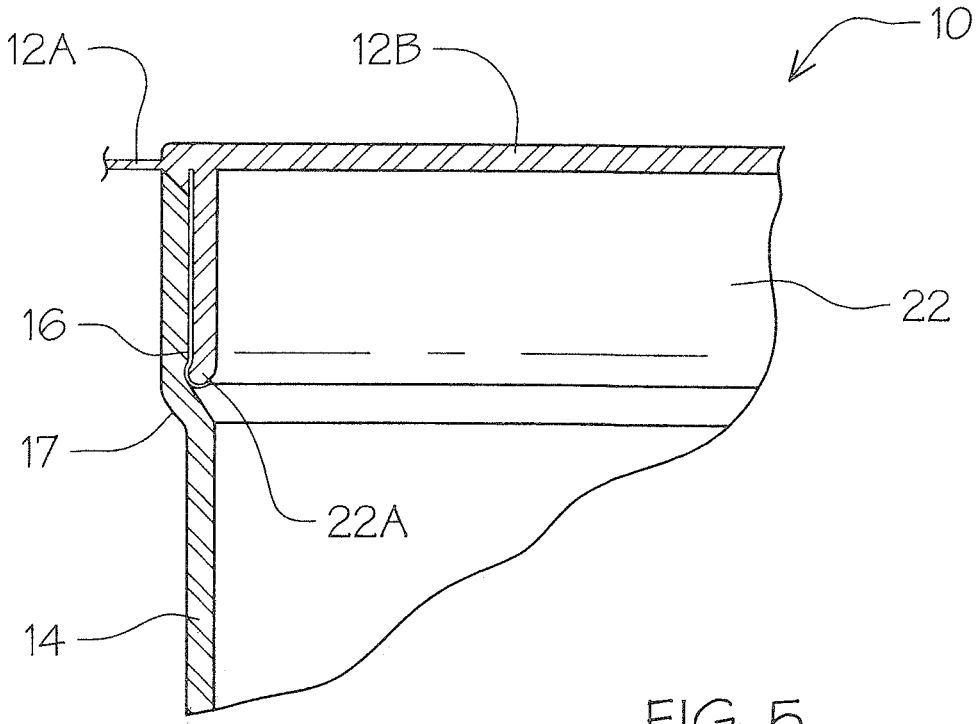
FIG. 5 is an enlarged partial sectional view of the hinge top and container engagement fitting in closed position.
Figure 6:
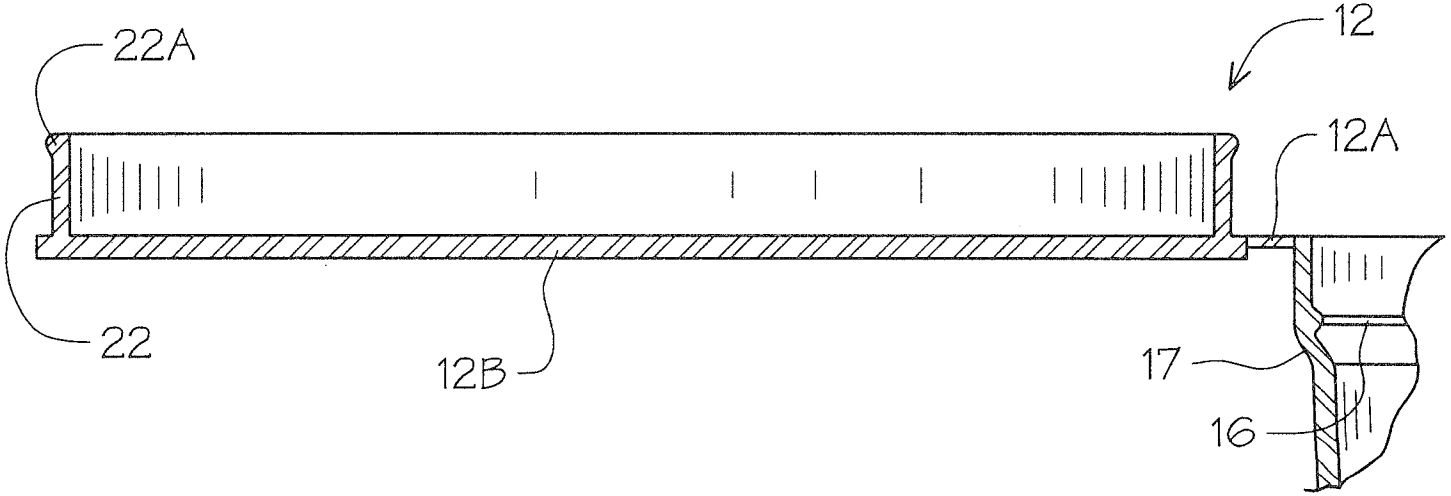
FIG. 6 is an enlarged partial sectional view of hinged top in open position.

Referring now to FIGS. 5 and 6 of the drawings, the hinge lid 12 can be seen having top 12B with an offset annular sidewall 22 extending therefrom having a registration end bead 22A formed thereon.

It will be seen therefore that when the lid 12 is so engaged as seen in FIG. 5 of the drawings, the lid 12 is removably secured within the lid receiving portion 15 of the cylinder body member 11 by the engagement of the end bead 21A with the hereinbefore described receiving portion's annular rib 16 retaining and sealing the closer lid 12 in place as will be understood by those skilled in the art.

The live hinge 12A secures the lid 12 to the cylinder top receiving portion 15 allowing for repetitive lid closure therewithin.

Figure 4:
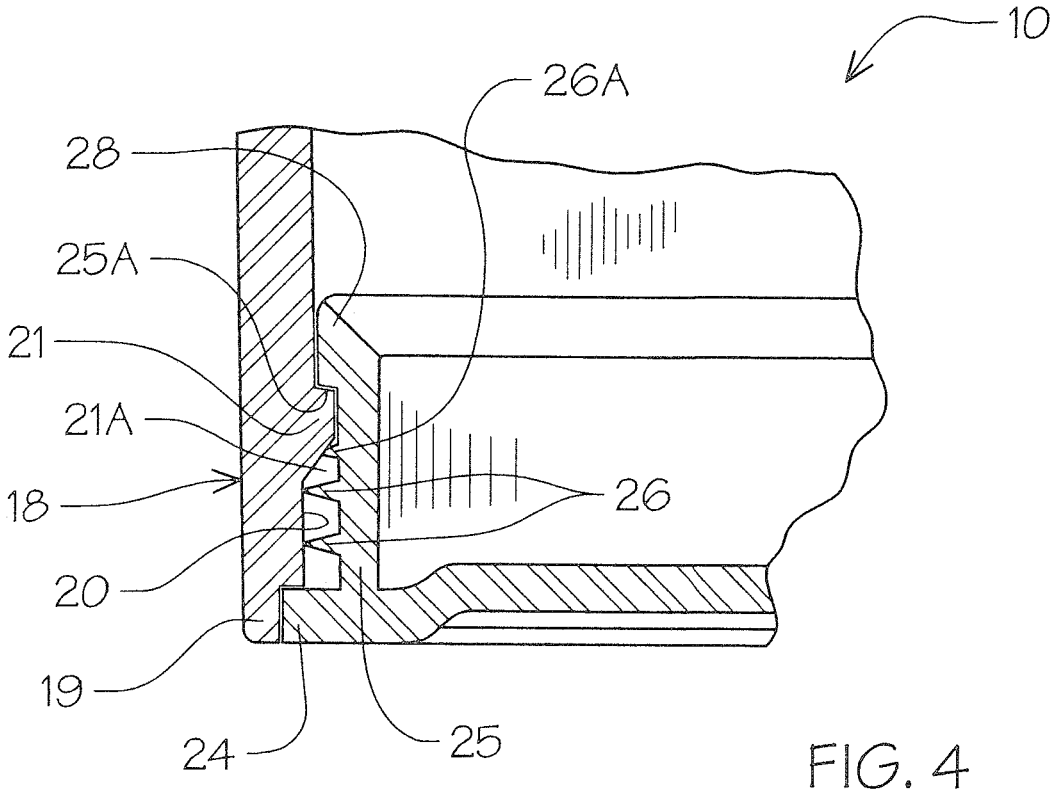
FIG. 4 is an enlarged partial sectional view of the retainment and sealing engagement bottom fitting orientation.

Referring now to FIGS. 1, 3 and 4 of the drawings, the container insert bottom 13 is independent and can be seen having an annular exterior stop flange 24 with an upstanding offset wall 25 extending therefrom. A pair of vertically spaced continuous annular sealing flanges 26 extends from the wall surface portion 27. The sealing flanges 26 engages corresponding receiving fitting sealing interior wall surface 20 with a secondary foreshortened sealing flange 26A positioned there above registering on a tapered surface 21A of the retainment flange 21, best seen in FIG. 4 of the drawings.

A locking retainment portion 28 of the insert bottom extends in spaced relation to sealing flange 26A from the annular wall 25 forming an exterior ledge 25A. It will be evident that during assembly the retainment portion 28 will initially engage and distort against the tapered surface 21A of the retainment flange 21 so as to pass over and then snap back in place on the retaining flange 20's upper surface. It will evident from the above description that by having an independent bottom closure insert 13 manufacturing and product utilization advantages can be achieved. The bottom container insert 13 will be inserted under applied direct pressure indicated by broken force arrows F in FIG. 1 of the drawings achieving a permanent sealed bottom closure for the container 10 independent of formation molding.

Figure 7:
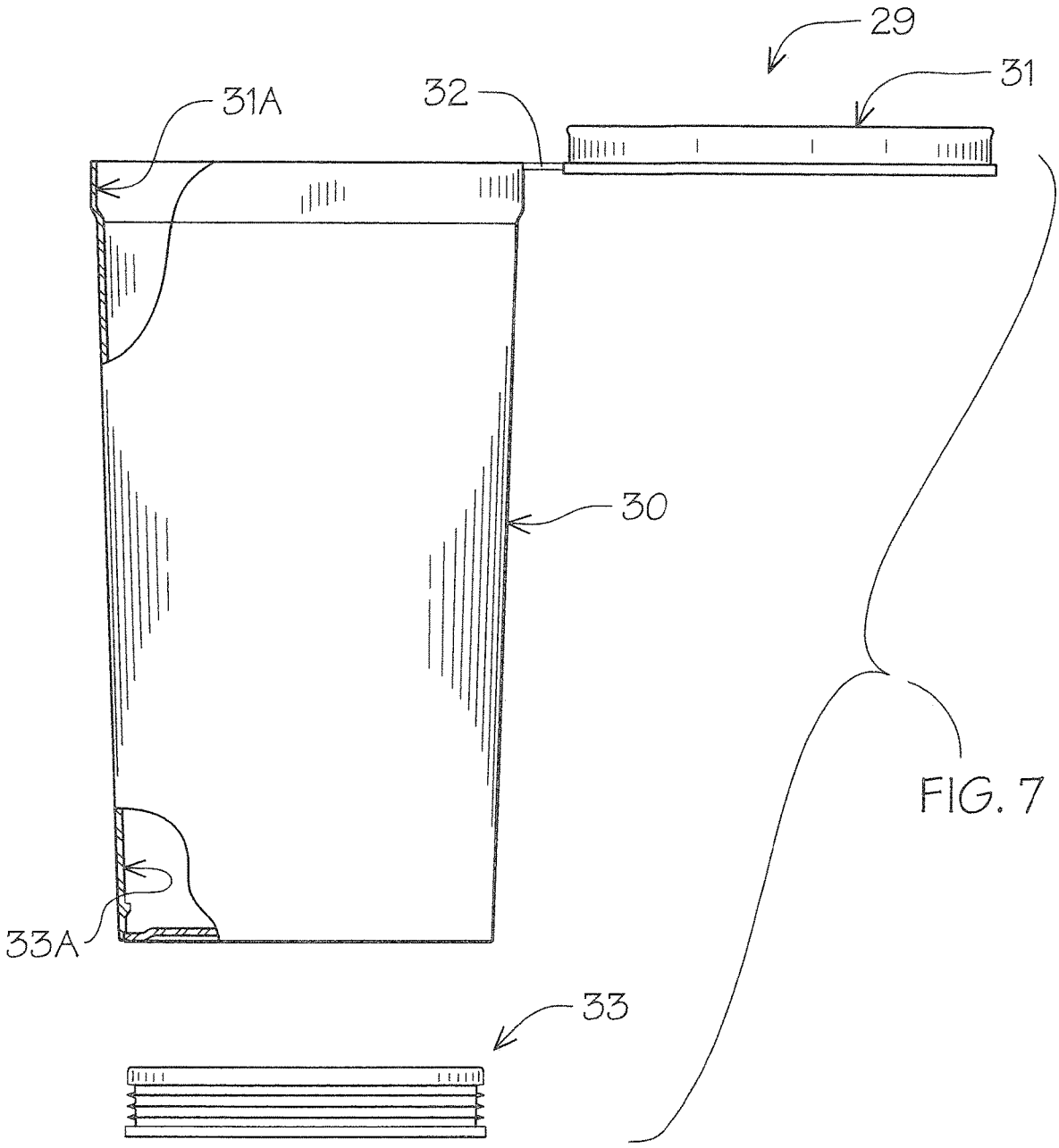
FIG. 7 is an exploded side elevational view of an alternate container configuration with portions shown in section.
Figure 8:
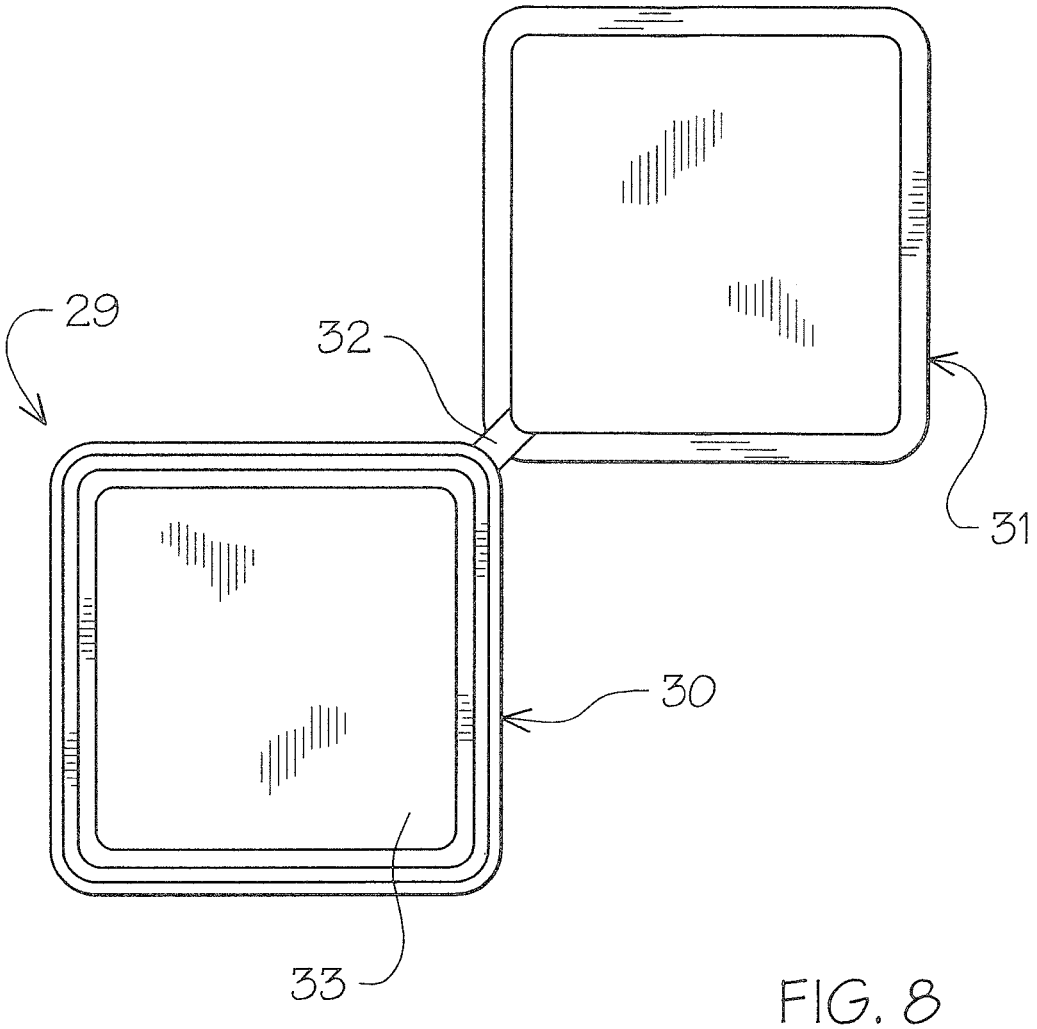
FIG. 8 is a top plan view thereof.

It will therefore be evident to one skilled in the art from the above description that the alternate container shape can be used as illustrated in FIGS. 7 and 8 of the drawings. Therein, an alternate container example 29 is illustrated having a cross-sectionally square body member 30 with corresponding hinge lid 31 via a live hinge 32. As hereinbefore described, in the preferred embodiment 10 an independent container bottom sealing insert 33 is also shown. The body member 30 has a top 31A and bottom 33A interior surface engagement configurations to respectively secure the hinge lid 31 and permanently retain the bottom insert 33 as hereinbefore described.

It will thus be seen that a new and novel container and method of manufacturing has been illustrated and described and it will be apparent to those skilled in the art that various changes and modifications may be made thereto without departing from the spirit of the invention.

Therefore, I claim:

1. A plastic container comprising, a main body with an open top and open bottom with a continuous flange in an inner main body side wall surface in spaced relation to said open top, a hinged lid extending from said open top registerable inside said main body, an interior bottom receiving surface in said main body sidewall having a continuous offset recessed base portion and an interior tapered wall defining retaining flange in spaced relation thereto, an independent insert bottom having a perimeter stop flange, and a plurality of vertically spaced flexible sealing flanges one of which is foreshortened and a locking retainment portion engageable with said tapered wall retaining flange during insertion in spaced relation to said foreshortened sealing flange.

2. The plastic container set forth in claim 1 wherein said hinge lid comprises, a top surface, a depending perimeter sidewall having an end retainment bead thereon and a live hinge interconnecting said hinge lid to said main body open top.

3. The plastic container set forth in claim 1 wherein some of said sealing flanges are registerable with said interior bottom receiving surface between said continuous offset base portion and said tapered wall retaining flange there above.

4. The plastic container set forth in claim 2 wherein said hinged lid depending sidewall end retainment bead aligned for selective registration with said continuous flange in a recess defined thereby.

5. The plastic container set forth in claim 1 wherein said foreshortened spaced flexible sealing flanges is engageable on a tapered surface said tapered wall retaining flange during insert bottom insertion.

6. The plastic container set forth in claim 1 wherein said insert bottom stop flange is of a known diameter greater than the interior diameter of said bottom receiving surfaces continuous recessed base portion in registration therewith.

7. The plastic container set forth in claim 1 wherein said interior bottom receiving surface tapered retaining flange and said insert bottom locking retainment portion comprises, a stop ledge and a retainment ledge respectively.

8. The plastic container set forth in claim 1 wherein said main body is cylindrical.

9. The plastic container set forth in claim 1 wherein said independent insert bottom stop flange portion and said flexible sealing flanges and said locking retainment portion are annular.

10. The plastic container set forth in claim 1 wherein said hinged lid is annular.

* * * * *